US005582307A

United States Patent [19]

Hawthorne et al.

[11] Patent Number: 5,582,307

[45] Date of Patent: Dec. 10, 1996

[54] RAILWAY CAR COUPLER KNUCKLE

[75] Inventors: V. Terry Hawthorne, Lisle; Horst T. Kaufhold, Aurora, both of Ill.; George G. Schwinn, Louisville, Ohio

[73] Assignee: AMSTED Industries Incorporated, Chicago, Ill.

[21] Appl. No.: 436,885

[22] Filed: May 8, 1995

[51] Int. Cl.[6] ..... B61G 7/00

[52] U.S. Cl. ..... 213/109; 213/155; 213/151; 213/152

[58] Field of Search ..... 213/155, 157, 213/109, 104, 118, 140, 151, 152

[56] References Cited

U.S. PATENT DOCUMENTS 3,670,901 6/1972 Metzger ..... 213/151
3,722,708 3/1973 Ion et al. ..... 213/151
3,856,156 12/1974 Metzger ..... 213/151
4,090,615 5/1978 Martin ..... 213/151
4,645,085 2/1987 Hanula et al. ..... 213/155

*Primary Examiner*—Mark T. Le
*Attorney, Agent, or Firm*—Edward J. Brosius; F. S. Gregorczyk; Stephen J. Manich

[57] ABSTRACT

A railway car coupler includes a knuckle that is rotatable about a pivot pin. The knuckle is comprised of a tail section, a hub and a nose section. The knuckle is usually made of steel in a casting operation. The pivot pin opening in the knuckle is cylindrical with generally straight walls with a reduced diameter centrally located cylindrical relief area. The nose has a blunt end, and a thicker internal reinforcing section is made by having an end of the face core extend a lesser distance toward the pivot pin opening. The transition area between the tail and the nose is formed by parabolic shaped upper and lower sections.

7 Claims, 5 Drawing Sheets

RAILWAY CAR COUPLER KNUCKLE

BACKGROUND OF THE INVENTION

This invention relates generally to railway car couplers and, more particularly, to an improved railway car coupler knuckle.

The invention is applicable to Association of American Railroads (AAR) type E and type F couplers which are comprised of a coupler shank and head, the coupler head having a vertical lock chamber and a pivotally connected coupler knuckle.

Railway car coupler knuckles are shown in U.S. Pat. Nos. 3,670,901, 3,722,708, 3,856,156, 4,090,615 and 4,645,085. The present invention provides an improved, strengthened knuckle, wherein modifications of the knuckle structure have resulted in a knuckle that is particularly stronger in the transition area of the knuckle and also in the knuckle pivot pin area. Such strengthened areas particularly improve the pulling strength of the knuckle.

Such railway car couplers and coupler knuckles are usually comprised of cast steel, and the interrelationship of the mold and the cores within the mold are critical to developing and producing an improved railway car coupler knuckle.

BRIEF SUMMARY OF THE INVENTION

In accordance with the present invention, an improved railway car coupler knuckle is provided for use in a railway car coupler assembly.

The coupler knuckle itself is comprised of integral nose, hub and tail sections. A pulling lug core is located between the cope and drag sections of the mold in the tail section of the knuckle. An independent pivot pin core is held between the cope and drag sections of the mold to form the pivot pin opening. A face core is also held between the cope and drag sections of the mold and forms the internal surfaces of the front face portion of the coupler, also including the nose and pulling face section of the coupler knuckle.

Prior known coupler knuckles have utilized a pivot pin core that included a bulge or an area of increased radius near the center of the pivot pin core. This bulge has been significantly reduced in the present invention to provide a pivot pinhole that is largely cylindrical formed by vertical cylindrical walls, with a centrally located relief area expanded to up to 108% of the pivot pinhole diameter.

The face core itself has been provided with top and bottom extensions that are received into, respectively, the cope and drag sections of the mold to support the face core. Further, the face core is of a decreased lateral dimension to allow for an increased thickness in metal in the coupler knuckle itself between the pivot pin opening and the internal void formed by the face core. This internal structural wall of the coupler provides increased strength to the end section of the nose of the coupler knuckle.

The pulling lug core itself is reconfigured to form more of an opposed parabolic shape to the upper and lower walls of the transition area between the knuckle tail and the front face section of the knuckle. The cope and drag sections of the mold themselves are also modified to provide the outer surface areas of this transition section of the coupler knuckle to provide vertically opposed parabolic shapes. The effect of the modification to the cope and drag molds and to the pulling lug core is to provide opposed parabolic shapes of the metal forming the transition area between the coupler tail portion and the coupler front face. The metal is configured so as to comprise two opposed parabolic shaped structures, the distance between which constantly decreases to the area of the closest spacing between the upper and lower metal surfaces. The upper and lower metal surfaces form the transition area of the knuckle.

The pulling lug and knuckle face cores are supported independently from the pivot pin core. The face core is supported as indicated above with pin sections extending upwardly into the cope and drag mold sections. The pulling lug core is supported with an end section that extends and is supported between the cope and drag mold sections, and by appropriate pinning using a metal rod extending across the cope and drag mold interface.

It is also part of the present invention to modify the end of the nose section of the coupler knuckle such that a blunter or flatter surface is provided rather than a more curved structure. Also desirable in manufacturing the improved railway car coupler of the present invention to eliminate any surface discontinuities in the transition area between the nose and the tail, by such means such as grinding. It is also desirable to flame harden or otherwise heat treat such transition areas.

It is an object of the present invention to provide a railway car coupler knuckle having a nearly straight cylindrical pivot pin opening.

It is also an object of the present invention to provide an improved railway car coupler knuckle having increased structural metal between the pivot pin opening and the nose section of the knuckle.

It is also an object of the present invention to provide parabolic relationships between the structural metal surfaces in the transition area of the coupler knuckle between the tail and the nose of the knuckle.

DETAILED DESCRIPTION OF THE PREFERRED EMBODIMENT

Figure 1:
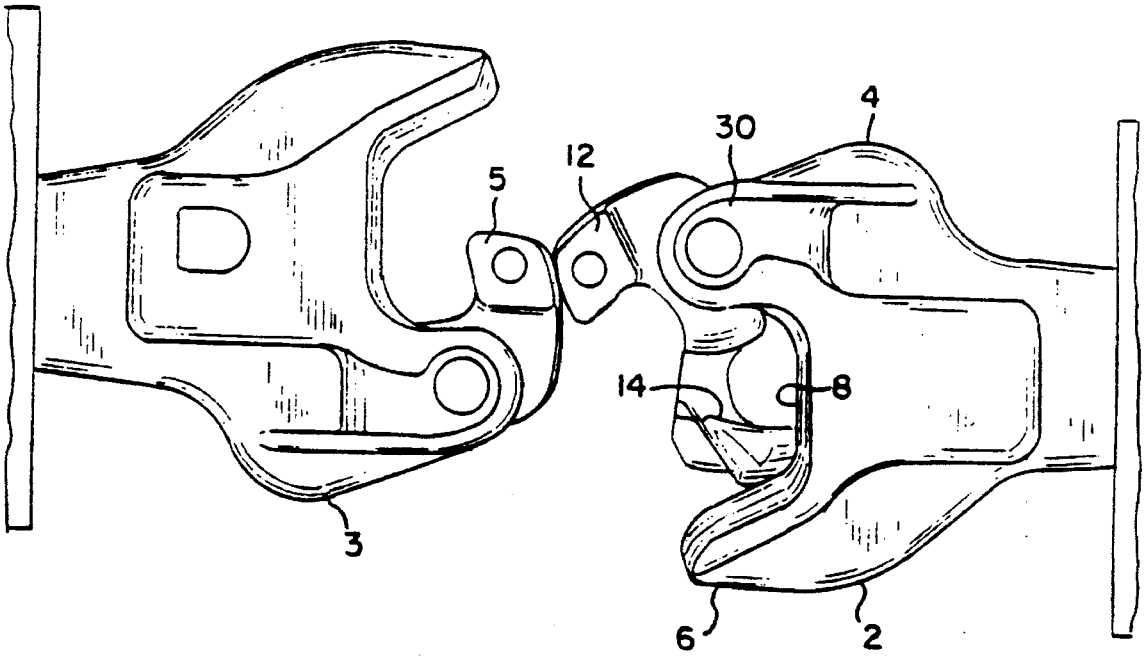
FIG. 1 is a top elevational view of two modified type E couplers meeting to couple in an off center line lateral relationship.

Referring now to FIG. 1 of the drawings, two type E railway car coupler heads are shown at a slightly off center coupling position. Coupler heads 2 and 3 are identical. Coupler head 2 is comprised of knuckle side 4, and an opposite guard arm 6 comprises the other side of coupler head 2. Interconnecting guard arm 6 with knuckle side 4 at the front of the coupler is front face 8. Note that coupler head 3 has its knuckle 5 in a closed position whereas coupler head 2 has its knuckle 12 in a fully open position. The details of the coupler locking structure and the interaction of the knuckle pulling lug 14 with internal locking structures in the coupler head are not part of the present invention, and accordingly are not described in detail.

Figure 2:
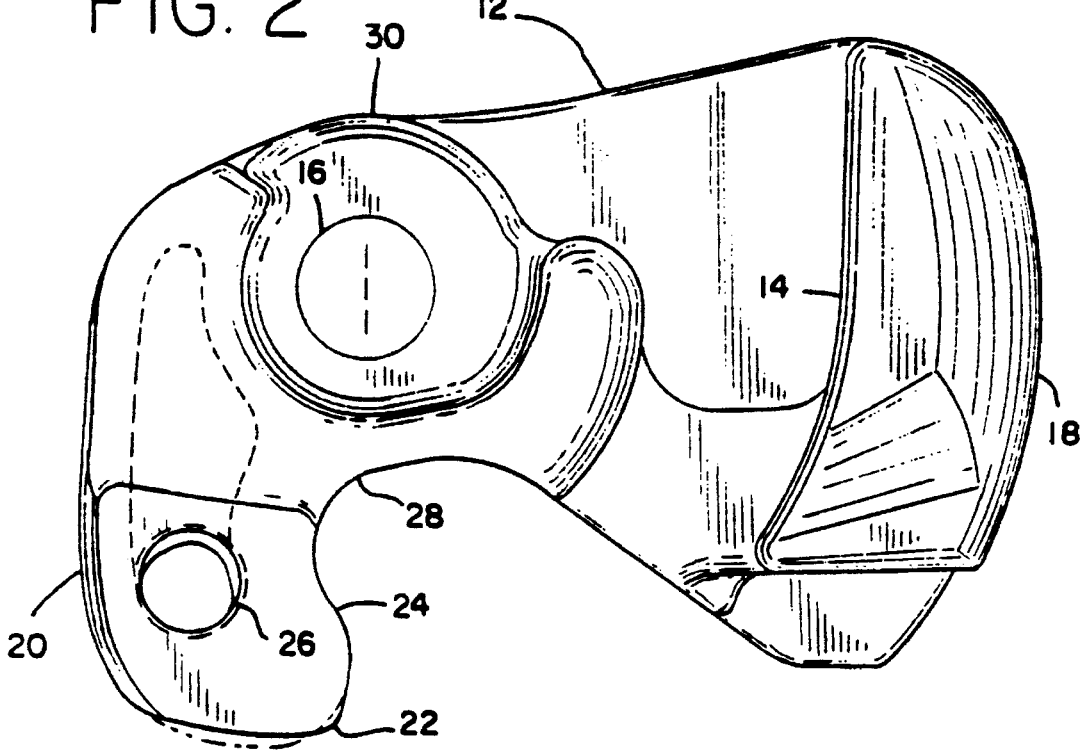
FIG. 2 is a top elevational view of a modified railway car coupler knuckle in accordance with the present invention.

Referring now to FIG. 2 of the drawings, knuckle 12 is shown in greater detail. The railway car coupler knuckle is usually comprised of steel and is usually manufactured in a casting operation. The unitary structure of knuckle 12 is apparent with knuckle 12 having a generally L-shape (viewed from the top) with the top of the L being tail section 18 of knuckle 12, with a raised pulling lug 14 in tail section 18 of knuckle 12. Hub section 30 includes top hub section 31 and bottom hub section 33 and joins tail section 18 to nose section 22. Pivot pinhole 16 is located in hub section 30, with front face 20 of knuckle 12 extending across from nose 22. Note that nose 22 is modified in the present invention to be blunt, with the formerly utilized more rounded section shown in dotted lines. Such blunt nose section 22 provides a greater strength and gathering capability during coupling, especially during off-center coupling such as shown in FIG. 1. Pulling face 24 of knuckle 12 is inward from nose 22. When two couplers such as 2 and 3 of FIG. 1 are coupled with their knuckles locked, it is seen that pulling face 24 would engage with a similar pulling face on the adjacent coupler head. Transition area 28 extends from pulling face 24 around toward knuckle tail 18. Transition area 28 is typically an arcuate section, with increasing radius of curvature from knuckle nose 22 toward tail 18. It is desirable to grind any surface discontinuities from transition area 28 opposite from pivot pinhole 16. It is also desirable to flame harden pulling face 24 to a minimum Rockwell hardness of 43Rc. Transition area 28 is a necessarily high strength area of the coupler knuckle as during pulling between locked couplers, it is readily seen that the loading of pulling face 24 would apply stress to transition area 28.

It should be understood that in a steel casting operation, a top or cope mold section is formed of casting sand, and a bottom or drag mold section is also formed of casting sand. Cores of resin or otherwise hardened sand are placed in the drag section prior to closing of the mold assembly by placing the cope mold section on top of the drag. The molten steel is then poured in the mold, taking up all space that is open between the cope, drag and cores. After solidifying, the mold is opened and the casting is shaken out, whereby the cores are broken up and exit from designed openings in the casting.

Figure 3:
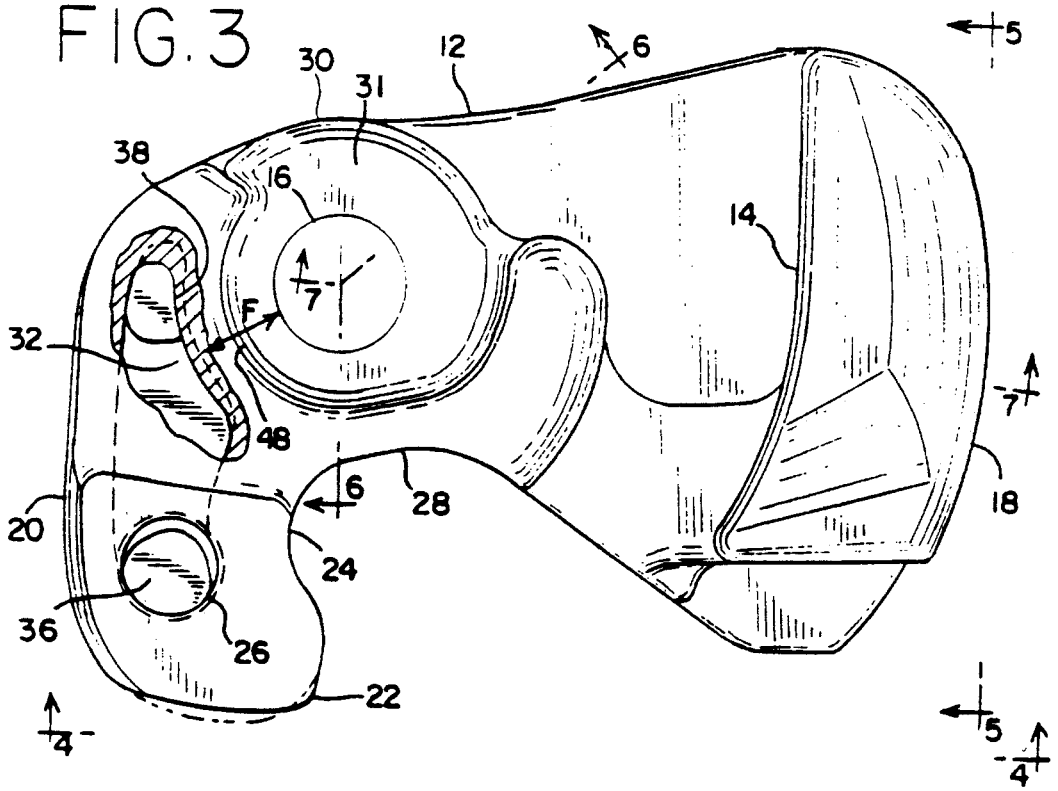
FIG. 3 is a top elevational view, in partial cross section, of a railway car coupler knuckle in accordance with the present invention showing the internal openings formed by the face core and the pivot pin core.
Figure 4:
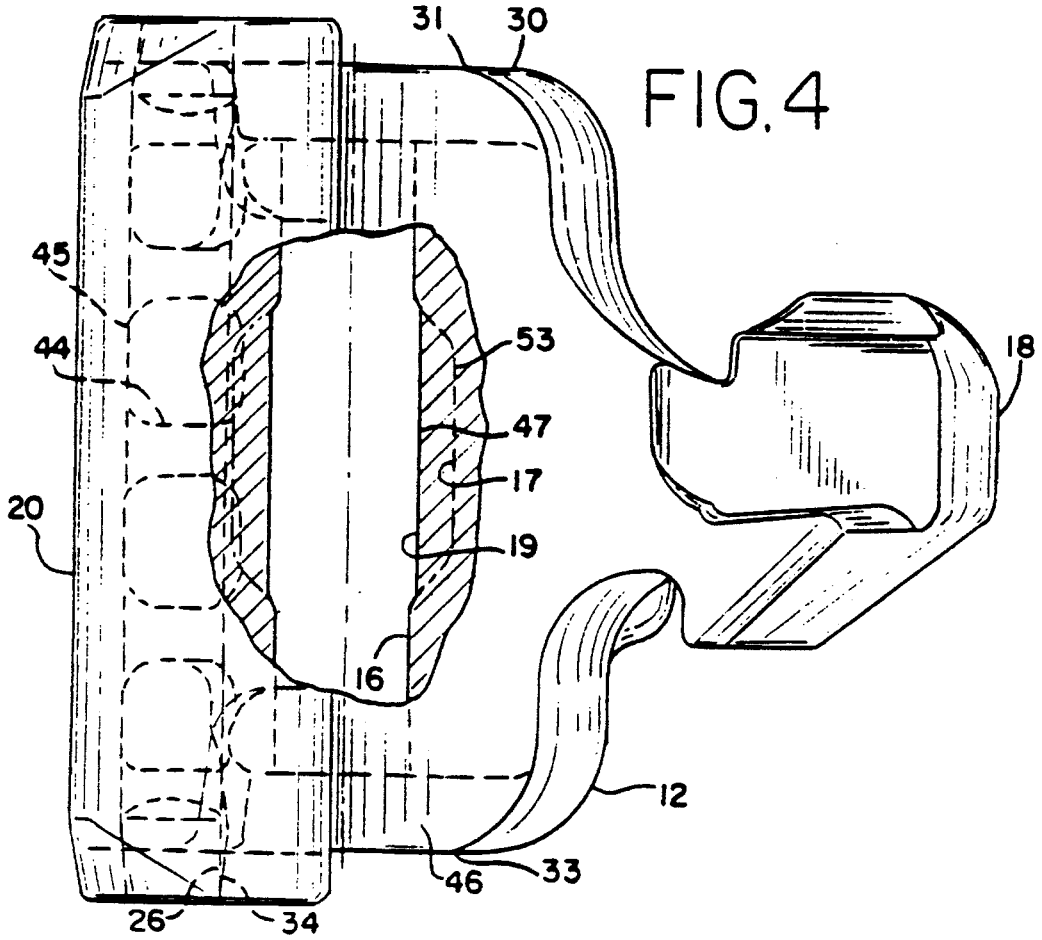
FIG. 4 is a side view of a railway car coupler knuckle in accordance with the present invention partially broken away to show the internal structure formed by the pulling lug core and the face core.
Figure 9:
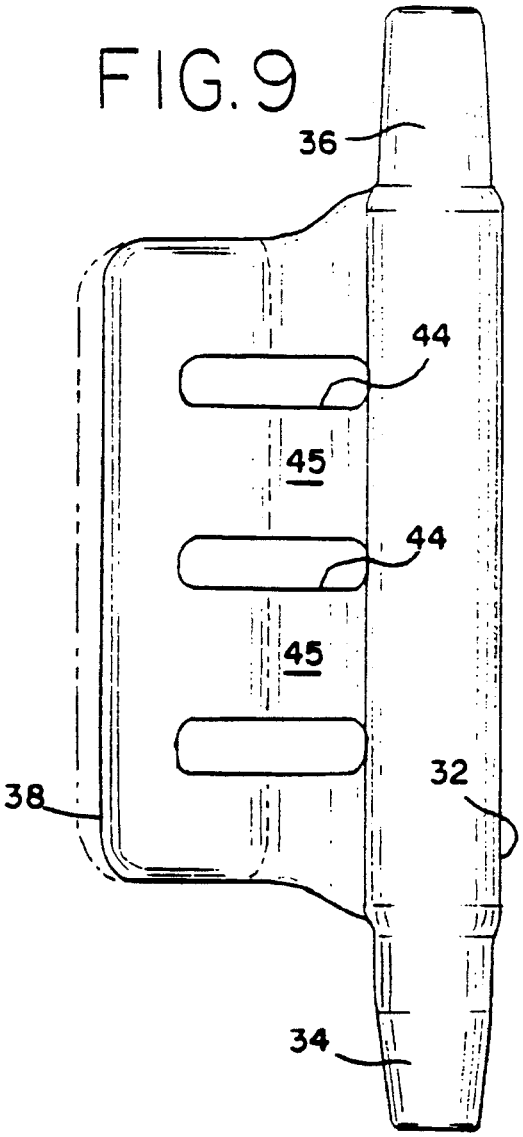
FIG. 9 is a side view of a face core used in the manufacture of a railway car coupler knuckle in accordance with the present invention.

Referring now to FIGS. 3 and 4 of the drawings, knuckle 12 is shown in a partially sectioned view such that certain of the cores utilized in the casting of knuckle 12 are shown. Face core 32 is seen as extending from near pivot pinhole 16 toward nose 22 of knuckle 12. Top face core pin 36 is seen as forming top extent of flaghole 26 in the nose portion 22 of knuckle 12. Bottom face core pin 34 extends to form the bottom extent of flaghole 26. An extended portion 38 of face core 32 extends toward pivot pinhole 16. However, the extent of the distance that extended portion 38 of face core 32 extends toward pivot pinhole is such that an increased area of cast metal exists between pivot pinhole 16 and the internal opening formed by the extended portion 38 of face core 32. This area of increased metal is shown generally as 48. The increase in a typical type E or F coupler is from a thickness in prior art couplers of a minimum distance F between pivot pinhole 16 and the face core opening of 1.125" to a minimum thickness of about 1.500" in the present invention coupler. Area 48 provides increased strength to knuckle 12, especially in nose section 22 and in the pulling face portion 24. Face core 32 also includes ribs 44 that result in openings 45 in the cast knuckle 12. Such openings allow the knuckle to be a lighter weight yet strong device. Knuckle front face ribs 44 are formed by the openings 45 in face core 32. A detailed view of face core 32 is provided in FIG. 9.

Figure 8:
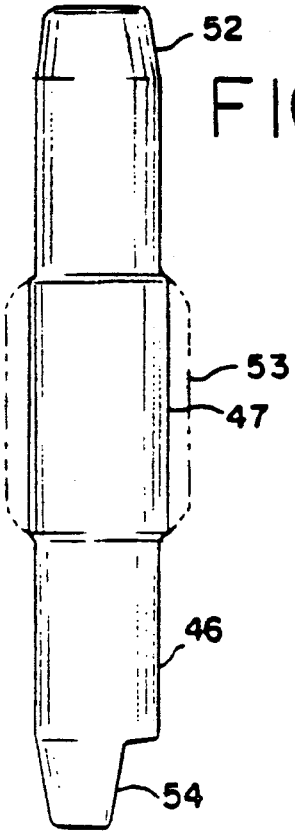
FIG. 8 is a side view of the pivot pin core used in the manufacture of a railway car coupler of the present invention.
Figure 11:
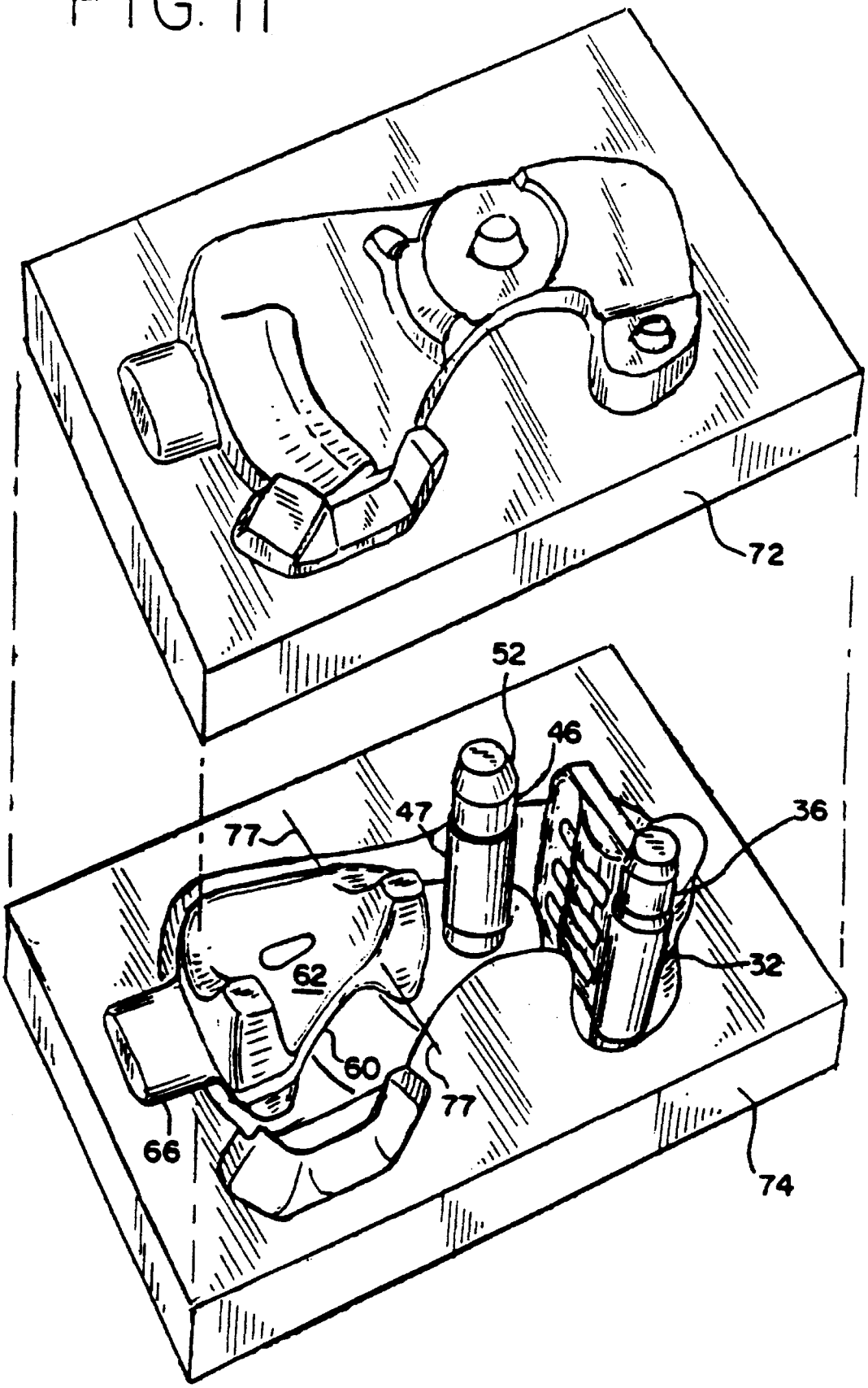
FIG. 11 is a perspective view of cope and drag mold sections with assembled cores used in the manufacture of a railway car coupler knuckle in accordance with the present invention.

Pivot pin core 46 is shown within knuckle 12 partially in FIG. 4 and in detail in FIG. 8. Pivot pin core 46 is shown to be a generally cylindrical device, usually constructed of a resin sand mixture. Pivot pin core 46 top is shown as an extended tapering portion 52 and pivot pin core 46 bottom is shown as an extended partial section tapering section 54. A reduced diameter central expanded area 47 is provided that is significantly less in diameter than prior art expanded area 53. Pivot pin core top 52 is received into cope section of the mold and pivot pin core bottom 54 is received into drag section of the mold. Cope section 72 and drag section 74 of the mold assembly are shown in FIG. 11. Pivot pin core 46 forms pivot pin opening 16 in knuckle 12, with the cast metal forming about pivot pin core 46.

Prior art expanded area 53 of pivot pin core 46 results in large diameter cylindrical void 17 within pivot pinhole 16. The present invention uses a reduced diameter expanded area 47 of pivot pin core 46 resulting in a smaller diameter cylindrical void within pivot pinhole 16.

Figure 5:
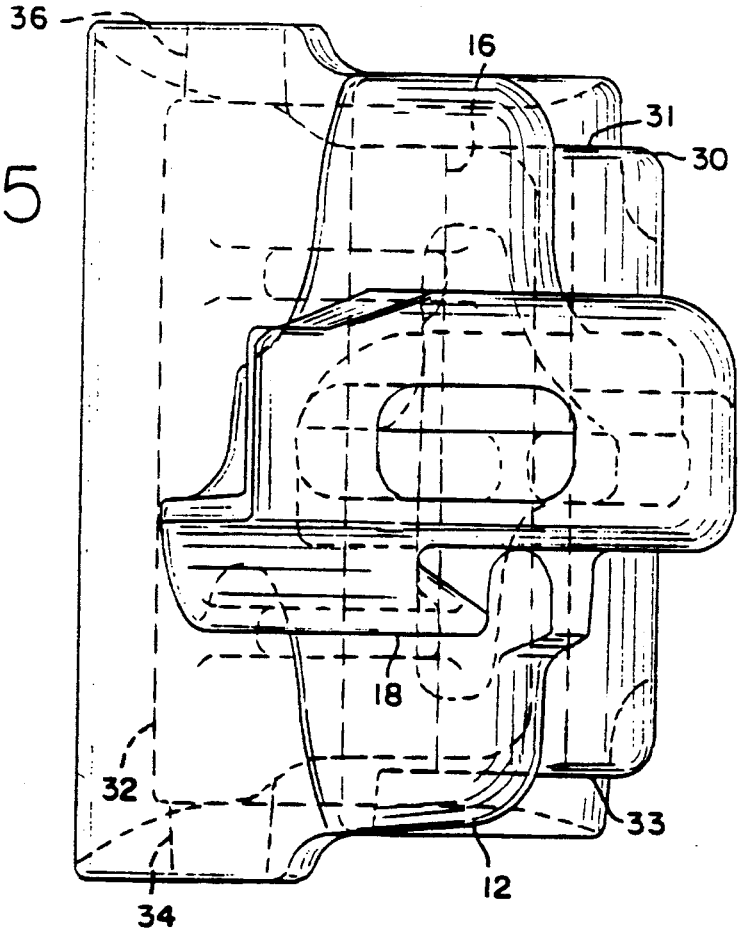
FIG. 5 is a rear view of a railway car coupler knuckle in accordance with the present invention.

FIG. 5 is a rear view of knuckle 12. Tail section 18 is seen as protruding from the main body of knuckle 12. Pivot pinhole 16 is visible in this view, as are bottom face core pin 34 and top face core pin 36.

Figure 6:
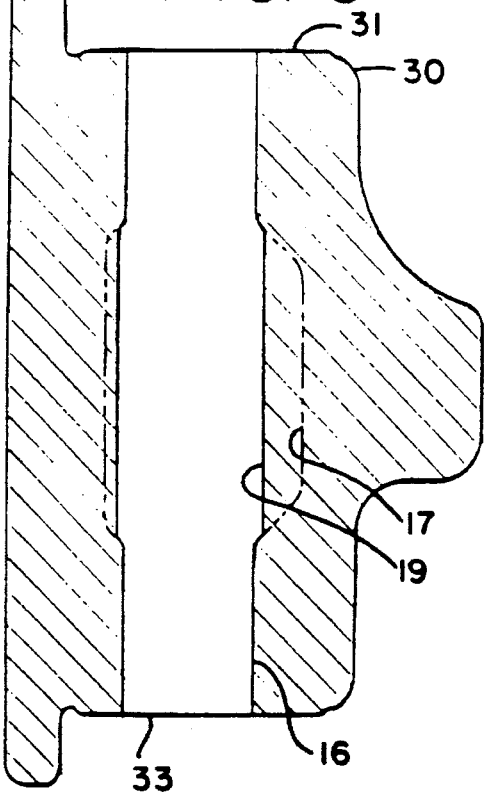
FIG. 6 is a sectional along lines 6—6 of FIG. 1 showing the detail of the pivot pinhole opening.

FIG. 6 is a sectional view along lines 6—6 of FIG. 3. Pivot pinhole 16 is shown in this view, with it apparent that pinhole 16 is formed by generally straight cylindrical walls of hub section 30 of knuckle 12. The prior art pivot pin structure is shown in dotted lines at 17 which formed a large diameter internally located cylindrical void 17 within pivot pinhole 16. This prior art void was usually 33% of the pivot pin opening. Pivot pinhole 16 of the present invention has a smaller diameter cylindrical void 19, with the increased diameter of void 19 being up to 108% of the diameter of pivot pinhole 16. It is not desirable to make a straight wall pivot pin due to difficulties that arise in casting cleaning (grinding) operations.

Figure 7:
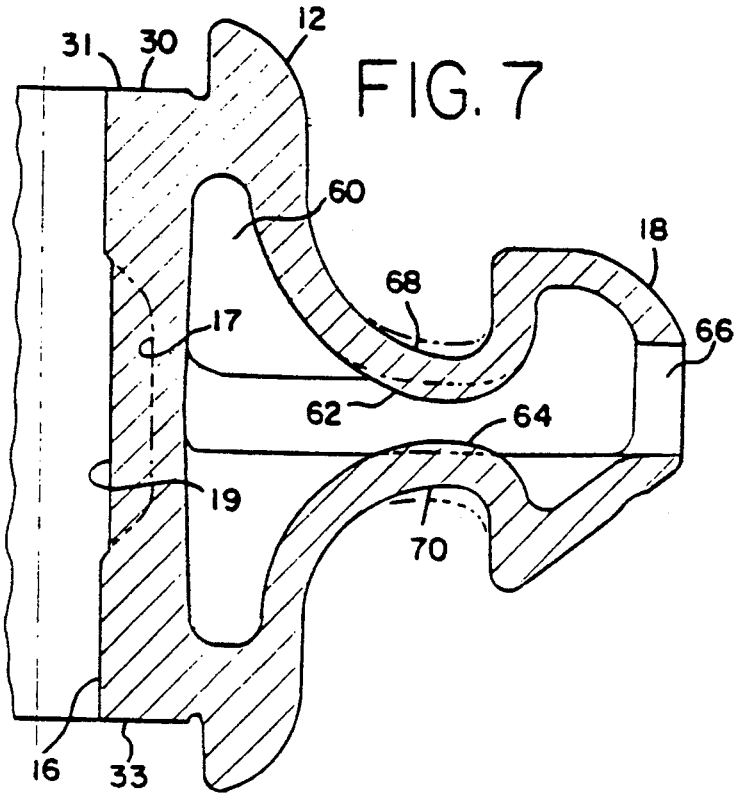
FIG. 7 is a partial cross sectional view of the railway car coupler knuckle along lines 7—7 of FIG. 3.
Figure 10:
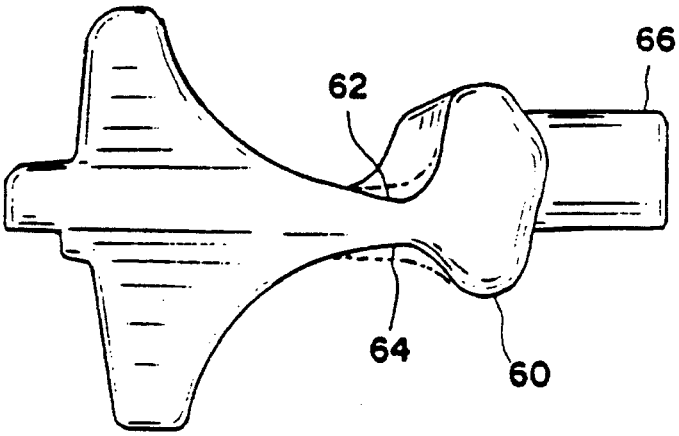
FIG. 10 is a view of a pulling lug core used in the manufacture of a railway car coupler knuckle in accordance with the present invention.

FIG. 7 is a sectional view along lines 7—7 of FIG. 3, and shows a detailed view of the tail section of knuckle 12. Pivot pinhole 16 is seen as a vertical cylindrical opening in knuckle 12. The opening that is apparent in tail 18 is formed by pulling lug core 60. Pulling lug core 60 is shown in detail in FIG. 10. Pulling lug core 60 is seen to be a two parabolic surfaced structure, formed by top parabolic surface 62 and bottom parabolic surface 64. It is seen that these surfaces interact in a fashion to cause the transition area of pulling lug core 60 to constantly decrease in thickness in approaching the transition area from either longitudinal direction, up to the point of least thickness. A core support end 66 extends outwardly from the transition area and is held between the cope 72 and drag 74 mold sections to support pulling lug core 60. As is shown in FIG. 11, pulling lug core 60 is also supported by a consumable metal pin 77 which is held between cope 72 and drag 74 mold section. It is apparent from FIG. 7 that the top transition surface 68 of knuckle 12 follows the parabolic shape of top parabolic surface 62 of pulling lug core 60. Similarly, bottom transition surface 70 of knuckle 12 follows bottom parabolic 64 of pulling lug core 60. The prior art nonparabolic surfaces are shown in dotted form in FIG. 7. The parabolic shape of the improved knuckle of the present invention provides greater strength, especially to the tail section of knuckle 12.

Also shown in FIG. 11 are face core 32 and pivot pin core 46. It is apparent from this view that in the mold assembly, face core 32 is held by bottom face core pin 34 extending into drag 74 mold section and the top face core pin 36 extending into the cope 72 mold section. Face core 32 is seen to be independently supported from the other cores.

Similarly, pivot pin core 46 is independently held with its top section 47 extending into the cope 72 mold and bottom pivot pin core 49 extending into the drag 74 mold section. Accordingly, pivot pin core 46 is independently supported in the mold assembly.

Pulling lug core 60 is supported by core support end 66 extending outwardly between the cope and drag mold sections. Comsumable metal pin or rod support 77 supports the front portion of pulling lug core 60 by extending through pulling lug core 60 and having its ends held between the cope 72 and drag 74 mold sections.

It is generally desirable to remove any surface discontinuities by means such as grinding from the inboard transition section 28 of knuckle 12 adjacent pulling face 24. It is also desirable to flame harden pulling face 24 to a minimum Rockwell C of about 43 Rc.

What is claimed is:

1. An improved railway coupler knuckle of metal composition comprising:

a tail section, a hub section and a front face section, a pivot pinhole opening formed in said hub section, wherein said pivot pinhole opening is formed of generally straight cylindrical side walls, with a centrally located relief area expanded to up to 108% of the pivot pin opening diameter, wherein said front face section includes a nose section and a generally cylindrical opening in an end section of said nose section of said front face section, said generally cylindrical opening being formed by a nose section face core, said nose section face core having a generally cylindrical core section that forms said generally cylindrical opening in said end section of said nose section and an extended section extending from said generally cylindrical core section, said extended section having a reduced lateral dimension to provide a thickness of metal of at least 1.5 inches between said pivot pinhole opening and the internal opening formed by the extended section of said face core, further comprising a transition section joining said tail section to said hub section, said transition section comprising a top metal section and a bottom metal section extending toward each other, and each of said top and bottom metal sections of a generally parabolic shape, wherein the distance between said top and bottom metal sections is formed by a pulling lug core and is of constantly decreasing distance when approaching the closest spacing point between an internal surface of said top and of said bottom metal sections of said transition sections.

2. The railway coupler knuckle of claim 1 wherein an inboard transition section generally inward from said nose section of said front face section and generally laterally outward from said pivot pinhole opening is ground to eliminate any surface discontinuities.

3. The railway coupler knuckle of claim 1 wherein a portion of said inboard transition section is flame hardened to a minimum Rockwell C of 43 Rc.

4. An improved railway coupler knuckle of metal composition comprising;

a tail section, a hub section and a front face section, a pivot pin opening formed in said hub section, said front face section including a nose section, a generally cylindrical opening in said nose section of said front face section, said generally cylindrical opening being formed by a nose section face core, said nose section face core having a generally cylindrical core section that forms said generally cylindrical opening in said nose section of said front face section and an extended section extending from said generally cylindrical core section, said extended section having a reduced lateral dimension to provide a thickness of metal of at least 1.5 inches between said pivot pinhole opening and the internal opening formed by the extended section of said face core, wherein said pivot pinhole opening is formed of generally straight cylindrical side walls, with a centrally located relief area expanded to up to 108% of the pivot pinhole opening diameter, further comprising a transition section joining said tail section to said hub section, said transition section comprising a top metal section and a bottom metal section extending toward each other and each of said top and bottom metal sections of a generally parabolic shape, wherein the distance between said top and bottom metal sections is formed by a pulling lug core and is of constantly decreasing distance when approaching the closest spacing point between an internal surface of said top and of said bottom metal sections of said transition section.

5. The railway coupler knuckle of claim 4 wherein an inboard transition section generally inward from said nose section of said front face section and generally laterally outward from said pivot pinhole opening is ground to eliminate any surface discontinuities.

6. The railway coupler knuckle of claim 4 wherein said inboard transition section is flame hardened to a minimum Rockwell C of 43 Rc.

7. An improved railway coupler knuckle of metal composition comprising;

a tail section, a hub section and a front face section, a pivot pinhole opening formed in said hub section, a transition section joining said tail section to said hub section, said transition section comprising a top metal section and a bottom metal section extending toward each other and each of said top and bottom metal sections of a generally parabolic shape, wherein the distance between said top and bottom metal sections is formed by a pulling lug core and is of constantly decreasing distance when approaching the closest spacing point between an internal surface of said top and of said bottom metal sections of said transition sections, wherein said pivot pinhole opening is formed of generally straight cylindrical side walls, with a centrally located relief area expanded to up to 108% of the pivot pinhole opening diameter, wherein said front face section includes a nose section and a generally cylindrical opening in said nose section, said generally cylindrical opening being formed by a nose section face core, said nose section face core having a generally cylindrical core section that forms said generally cylindrical opening in said end section of said nose section and an extended section extending from said generally cylindrical core section, said extended section having a reduced lateral dimension to provide a thickness of metal of at least 1.5 inches between said pivot pinhole opening and the internal opening formed by the extended section of said face core.

* * * * *